US006400244B1

(12) United States Patent
Bergamo et al.

(10) Patent No.: US 6,400,244 B1
(45) Date of Patent: Jun. 4, 2002

(54) CONTROL APPARATUS FOR ELECTRICAL SWITCHGEAR

(75) Inventors: Dario Bergamo, Venice (IT); François Biquez, Brignais (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/557,966

(22) Filed: Apr. 25, 2000

(30) Foreign Application Priority Data

Apr. 26, 1999 (FR) ..... 99 05232

(51) Int. Cl.[7] ..... H01H 3/00

(52) U.S. Cl. ..... 335/195; 200/401

(58) Field of Search ..... 335/167–176, 335/185–195; 200/401

(56) References Cited

U.S. PATENT DOCUMENTS

| | | | | |
|---|---|---|---|---|
| 3,798,395 A | * | 3/1974 | Normal et al. | 200/401 |
| 4,103,133 A | | 7/1978 | Erickson et al. | |
| 5,722,706 A | * | 3/1998 | Bartel et al. | 292/201 |

FOREIGN PATENT DOCUMENTS

| | | | |
|---|---|---|---|
| DE | 2 216 272 A | | 10/1973 |
| DE | G 82 13 505.3 | | 8/1982 |
| DE | 3443054 A1 | * | 12/1985 |
| DE | 3710374 A1 | * | 3/1987 |
| DE | 37 10 374 A1 | | 10/1988 |
| DE | EP 0 763 839 A2 | | 3/1997 |

* cited by examiner

*Primary Examiner*—Lincoln Donovan
(74) *Attorney, Agent, or Firm*—Sughrue Mion, PLLC

(57) ABSTRACT

A three-position control apparatus has a control shaft secured to a Maltese cross provided with two drive slots and rotated from a determined angular position to an angular position from among two other determined angular positions. The Maltese cross is rotated in this way by one or the other of two studs fixed to a drive shaft and associated with a cam that is complementary to the Maltese cross. Rotation of the drive shaft is limited by the action of a fixed stop abutment which stops the rotation in each of the two rotation directions at the two chosen starting and finishing end positions, and by a complementary shaft-stopping mechanism that prevents the shafts from rotating from the determined intermediate position by interposing a stop element in the path that is followed by a projecting complementary element carried by one of the shafts as it rotates.

7 Claims, 2 Drawing Sheets

CONTROL APPARATUS FOR ELECTRICAL SWITCHGEAR

The invention relates to three-position control apparatus for electrical switchgear and itself controlled by means of a rotary shaft, and in particular for an electrical power station switch. More particularly, it relates to apparatus for causing switchgear to go from one position to another in determined manner, either automatically by means of an electrical command from a central control unit, or optionally manually by means of a crank handle, in the event of a power failure and in particular a failure at the central control unit.

BACKGROUND OF THE INVENTION

Such apparatus serves to remove the possibility of the switchgear going from one position to another without a command being given to that effect, as well as the possibility of the switchgear going from one position to another without following a given sequence, e.g. going from a first position to a third position without going through the second position which is required as being a necessary intermediate position.

For reasons of staff safety and/or of protecting equipment, it is often necessary to require a determined sequence for going from one position to another so as to satisfy given conditions, e.g. so as to avoid untimely grounding of a link that is live.

For example, such conditions are imposed for apparatus serving to control a generator circuit in a facility for generating electrical power. In such a facility, the apparatus makes it possible either to cause an interconnection to be established between the generator and a grid transformer by closing a disconnector, or to cause such an interconnection to be interrupted by opening the disconnector, or else to cause grounding to take place, with the disconnector open.

OBJECT AND SUMMARY OF THE INVENTION

The invention thus provides control apparatus for controlling electrical switchgear by rotating a control shaft, to go only from a determined angular position to one of a plurality of other determined angular positions, under the action of electrically or mechanically controlled drive mechanism.

BRIEF DESCRIPTION OF THE DRAWINGS

The invention, its characteristics, and its advantages are described in more detail in the following exemplary description given with reference to the following figures.

MORE DETAILED DESCRIPTION

Figure 1:
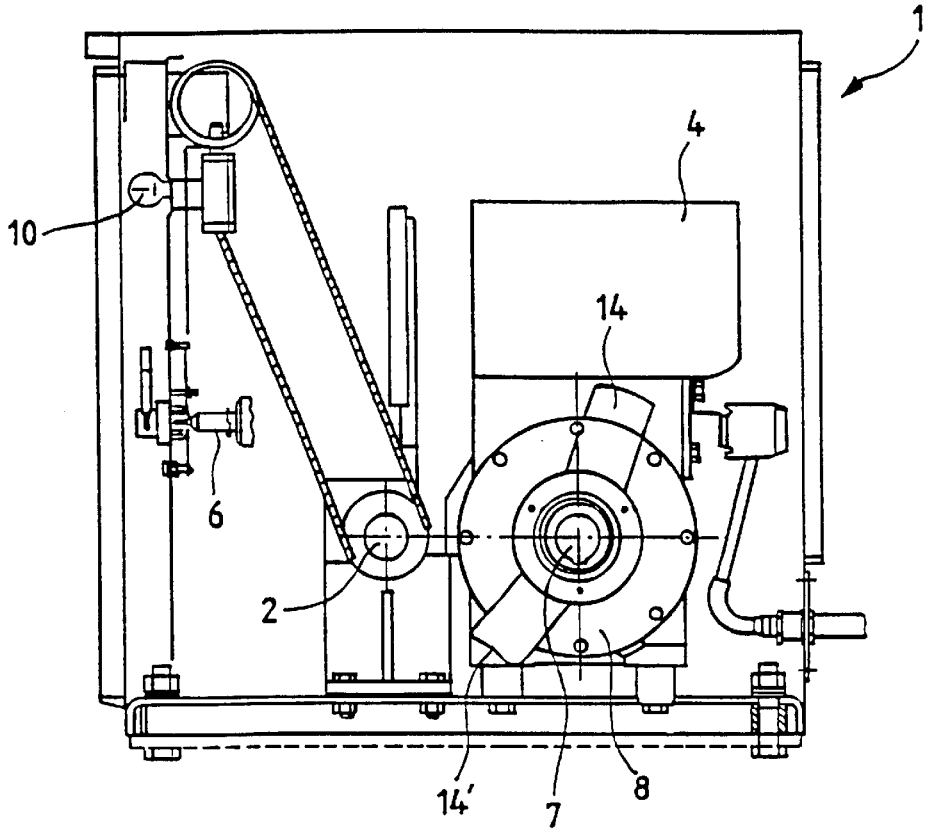
FIGS. 1 and 2 respectively show a front view and a plan view of an embodiment of the control apparatus of the invention.
Figure 2:
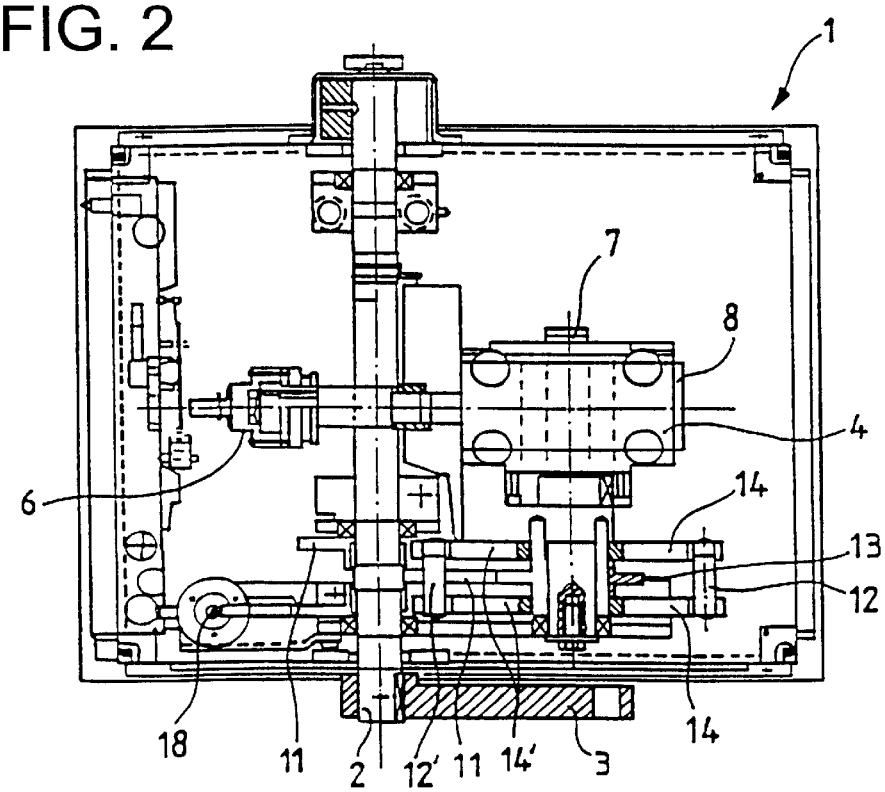

The control apparatus 1 shown in FIGS. 1 and 2 is more particularly designed to equip electrical switchgear, in particular medium-voltage or high-voltage switchgear, that can be operated by a rotary control shaft 2, the switchgear not being shown in the figures insofar as its structure is-not in any way related directly to the present invention.

The switchgear is assumed to be put in a determined state from among a plurality of possible states as a function of the angular position occupied by the control shaft 2. For example, this position corresponds to the positioning of an operating arm 3 projecting laterally from one end of the shaft 2.

In the embodiment considered with reference to FIGS. 3 to 6, provision is made for the control shaft to be able to take up three distinct determined positions offset by 90° relative to one another, from 0° to 180°. It is also considered herein that going from either of the end positions at 0° and 180° must necessarily involve going through the intermediate position 90°, for technical reasons imposed by the operating mode of the controlled switchgear.

In the example of use under consideration, the limited rotations of the control shaft 2 can be caused either by the action of an electric motor 2 or optionally by means of a manually-actuated crank handle if the motor cannot or must not be used.

A conventional mechanism 6 that is not described in detail herein makes it possible to drive the control shaft in either direction by means of the crank handle 5 via a drive shaft 7. The electric motor 4 acts on the drive shaft 7 via a worm screw gear 8, and the rotations of the drive shaft 7 in one or the other direction correspondingly lead to rotations of the control shaft 2 in the opposite direction, by means of a mechanical arrangement which operates as described in detail with reference to FIGS. 3 to 6.

In the practical embodiment presented, the control apparatus is associated with a system for mechanically locking the control shaft by means of locks, which system is represented in the figures by an endless chain associated with a lock 10 provided with a key. This apparatus is not described in detail herein because it is not part of the present invention.

The mechanical arrangement which makes it possible for the drive shaft 7 to co-operate with the control shaft 2 comprises a Maltese cross 11 fixed to the control shaft 2. Two Maltese cross drive studs 12, 12' fixed at the same distance from the drive shaft 7 are associated with a cam 13 that is complementary to the Maltese cross. This cam is fixed to the drive shaft which is positioned parallel to the control shaft 2.

In the embodiment considered, the studs 12 and 12' are carried by two arms 14, 14' of a support piece which is open dihedron or "bell-crank" shaped and which has its vertex fixed to the drive shaft.

The cam 13 comprises two diametrically-opposite and unequal sectors which are symmetrical about a transverse midplane and which are provided laterally with concave setback curves for accommodating the arms of the Maltese cross when cam and cross are in motion. The peripheral edges of the sectors have convex curves which are complementary to the curves presented by the Maltese cross between two arms. These curves are provided at three of the four quadrants of the cross, in the example presented in which three distinct angular positions of the control shaft are provided at 0°, 90°, and 180°. Two of the cross arms 11A, 11B which are disposed at right angles are provided with longitudinal slots for receiving respective ones of the drive studs 12 and 12'.

Figure 4:
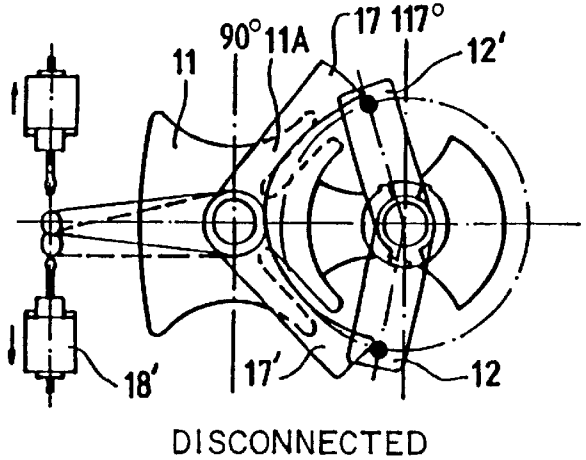

As is known, the studs rotating in a determined direction with the drive shaft that carries them causes one or the other of the studs to come in front of the inlet of the slot in an arm, into which slot it penetrates. This causes the stud to bear against one of the edges of the slot, thereby causing the Maltese cross to rotate through 90°. This operation can be repeated twice, starting from an initial cross position, as shown in FIG. 4 for a counter-clockwise rotation. The same applies in the clockwise direction starting from the cross position situated at 180° from the above-considered initial position.

The control shaft 2 which carries the Maltese cross is held stationary by the drive shaft 7 which carries the cam 13 and the studs 12 and 12', if the drive shaft is stationary. This is a result of the complementary curves of the two cam sectors and of the three Maltese cross quadrants which are adjacent to one of the arms provided with slots. This result is used for each of the three control shaft positions at 0°, 90°, and 180°.

The rotation of the drive shaft 7 is limited in each of the two possible rotation directions by a fixed stop abutment 15 situated in the vicinity of the shaft so as to be interposed in the path followed by a complementary abutment 16 integral with the drive shaft as said drive shaft rotates. These stops 15 and 16 are implemented in the form of annular sectors angularly defined such that the abutment 16 comes into abutment on one side or the other side of the abutment 15 depending on the rotation direction imparted by the drive shaft, when said drive shaft reaches the position for which it is either in position 0° in one case, or in position 240° in the other case.

A complementary mechanism for stopping the shafts is included in the control apparatus of the invention to prevent the control shaft from rotating after it has reached an intermediate position, if said rotation has not been authorized by a specific electrical or manual command.

In the embodiment proposed, provision is made for a single intermediate position between the two end positions at 180° and for a control shaft position at 90°.

In this example, the stop mechanism comprises a moving stop element for each rotation direction, each element being interposed in the path followed during the rotation by a complementary projecting element carried by one of the shafts 2 and 7. In the embodiment proposed, the complementary elements are mounted on the drive shaft, and each of them is constituted by one of the drive studs 12, 12'.

The moving stop elements are constituted by two levers 17 and 17' which can be displaced so that one or other of them is interposed via an abutment end in the path followed by the studs so as to prevent the shafts from continuing to rotate, when a stud comes into abutment against an abutment end.

In the embodiment proposed, the two levers 17 and 17' form a bell crank, and this bell crank is mounted to rotate about an axis situated at the vertex of the bell crank, which axis is constituted, in this example, by the axis of the control shaft 2 itself. The movements of the bell crank in the opposite direction make it possible to interpose the abutment end of one or other of the levers 17, 17' alternately in the path followed by the studs, during the rotation of the drive shaft 7 that carries them.

Figure 5:
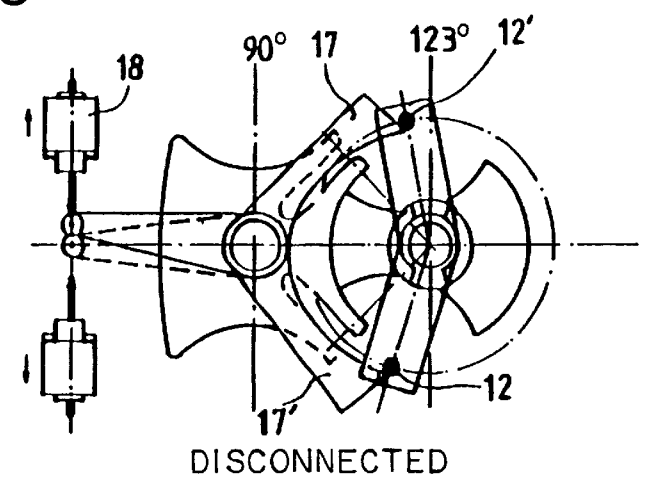

A limit bell crank position corresponds to the abutment end of the lever 17 being interposed in the circular path followed by the studs. The rotation of the drive shaft 7 in the counter-clockwise direction is stopped when the stud 12' comes into abutment against the abutment end of the lever 17 as shown in FIG. 5. A second limit position is reached when the stud 12 comes into abutment against the abutment end of the lever 17' while the drive shaft 7 is rotating clockwise, as shown in FIG. 4.

For example the bell crank is caused to rotate about the control shaft by means of two antagonistic electromagnets 18 and 18' which act alternately by attraction on a drive lever 19 fixed to the levers 17 and 17' at the vertex of the bell crank.

Figure 3:
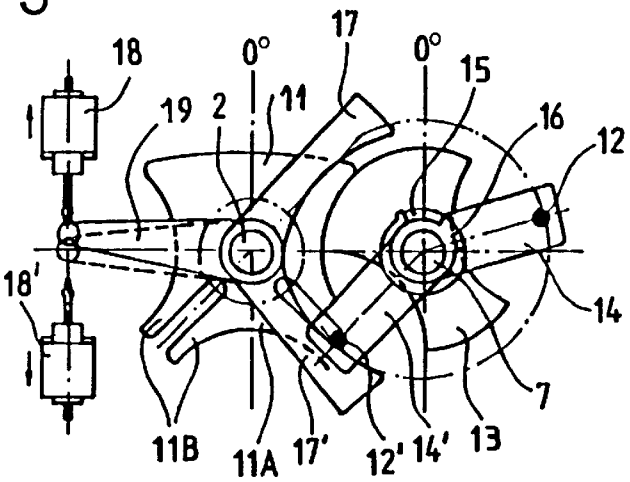

On being powered, the electromagnet 18 attracts the lever 19 and causes the abutment end of the lever 17 to be interposed in the path of the studs, as shown in FIGS. 3 and 5.

Figure 6:
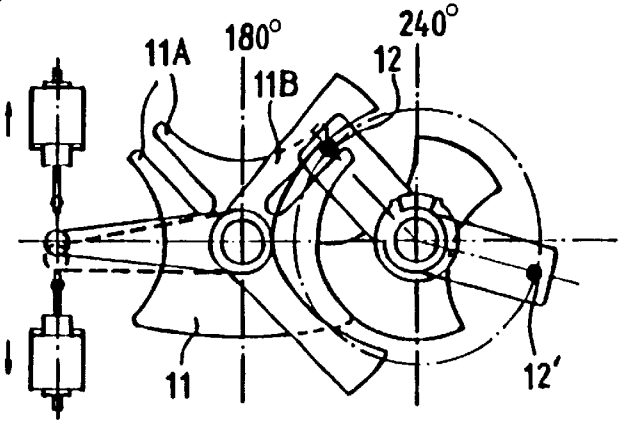
FIGS. 3, 4, 5, and 6 are diagrams showing four characteristic states of the control apparatus of the invention.

On being powered, the electromagnet 18' attracts the lever 19 and causes the abutment end of the lever 17' to be interposed in the path of the studs, as shown in FIGS. 4 and 6.

Manually controlling the drive lever 19 makes it possible to obtain the same results.

The angle formed by the levers 17 and 17' and the shape of the levers inside the bell crank are chosen to enable the bell-crank to be displaced due to the pressure exerted laterally by a stud against a lever inside the zone delimited internally by the two levers 17 and 17', when said stud is displaced therein.

In the embodiment proposed, the lever edge situated inside the bell crank for each lever is curved such that it is recessed progressively from the stop abutment to the vertex of the bell crank so that the pressure with which a stud bears laterally along said edge as it moves along its path varies from a maximum value at the lever end to a zero value at the vertex of the bell crank.

The control shaft and the drive shaft rotate from the 020 position to the 90° position under the action of the motor 4 or, failing that, under the action of the crank handle 5.

In this example, the starting position is assumed to be such that the stud 12' is situated upstream from the inlet of the slot in the arm 11*a* and in abutment against the inside edge of the arm between the abutment end and the vertex of the bell crank formed by the levers 17, 17'. The pressure exerted by the stud 12', while it is being displaced in the slot in the arm 11A, drives the Maltese cross 11 and the control shaft 2. This displacement of the stud 12' along the lever 17' tends to cause the bell crank to turn counterclockwise, by bringing the abutment end of the lever 17' into the circular path of the studs. The stud 12 is then on an approach path approaching the abutment end of the stop lever 17' against which it comes into abutment. By bearing against said abutment end, the stud 12 stops the drive shaft and therefore the control shaft. In the embodiment presented, this stopping is obtained once the drive shaft has rotated through 117°. The control shaft is then held stationary in its intermediate position at 90° by means both of the Maltese cross 11, and also of the complementary cam 13 that is carried by the drive shaft 7, as shown diagrammatically in FIG. 4.

It is possible to return to the control position at 0° from the control position at 90°, insofar as the angle of the bell crank and the position of the levers 17, 17' relative to the studs cause the stud 12' to bear against the inside edge of the lever 17, between the abutment end of said lever and the vertex of the bell crank. It is then necessary merely to rotate the drive shaft 7 in the counter-clockwise direction by means of the motor 4 or by means of the crank handle 5.

In order to go to the control position at 180° from the intermediate control position at 90, it is necessary for the abutment end of the lever 17' to be no longer interposed in the path of the studs, and for the bell crank to be rotated clockwise so as to enable the stud 12 to go past the abutment end of the lever 17'. This is obtained by triggering a traction action by the electromagnet 18 on the drive lever 19, as shown diagrammatically in FIG. 6. The abutment end of the lever 17' being withdrawn from the path of the studs makes it possible for the stud 12 to rotate with the drive shaft 7 as duly driven. The drive shaft can then rotate until it reaches the end position which, in this example, is assumed to be reached for a rotation through 240° clockwise from the initial position. the corresponding position reached by the control shaft 2 is then the end position at 180°, as shown in FIG. 6.

In order for the control shaft to return from this position at 180° to the starting position at 0°, it is necessary for it to go through the intermediate position at 90°. The drive shaft being rotated counter-clockwise cause the stud 12 to penetrate into the slot in the arm 11B of the Maltese cross, and drives said cross clockwise. The rotations of the shafts and of the Maltese cross continue until the stud 12' comes into abutment against the abutment end of the lever 17 which is then interposed in the path of the studs, as shown in FIG. 5. The control shaft is then once again in the intermediate position at 90°. It is then possible to go from the shaft position shown in FIG. 5 to the position shown in FIG. 6 without having to act on the electromagnet.

Traction from the electromagnet 18' is then necessary to cause the bell crank to rotate counter-clockwise and to withdraw the abutment end of the lever 17 from the path of the studs, as shown in FIG. 5. It is then possible for the control shaft to return to its origin position at 0°, as shown in FIG. 3, by the drive shaft rotating counter-clockwise until the abutment 16 carried by the drive shaft comes into abutment against the fixed abutment 15.

The three-position control apparatus as described above is, in particular, organized to equip electrical switchgear including a busbar section disconnector having an earthing knife or associated with an earthing switch, as provided, for example, in a generator circuit of an electricity generating station between the generator and a grid transformer. It then makes it possible to control the busbar disconnector and the earthing in a manner enabling three positions only, namely one position in which the busbar disconnector is closed, an intermediate position in which said disconnector is open and in which the earthing is not established, and a third position in which the earthing is established by closing the knife or the earthing switch.

What is claimed is:

1. Control apparatus for controlling electrical switchgear, comprising:

a control shaft that is rotated clockwise or counter-clockwise in order to effect the controlling of the electrical switchgear;

a drive shaft rotated by a drive mechanism that is one of electrically and manually controlled, said drive shaft disposed parallel to said control shaft;

a Maltese cross having a plurality of arms radially extending from its center and provided with two drive slots disposed substantially at right angles to each other on ones of said plurality of arms, said Maltese cross being secured to said control shaft so that said arms rotate with said control shaft, said Maltese cross being rotated from a first determined angular position to a second angular position that is one of two other determined angular positions, said Maltese cross being rotated in this way by abutment of one or the other of two studs fixed to said drive shaft;

a fixed stop abutment disposed in the vicinity of said drive shaft and operative to stop the rotation of said drive shaft in each of the clockwise and counter-clockwise rotation directions at starting and finishing rotation positions of said drive shaft; and a shaft-stopping mechanism that is one of electrically and manually controlled and operative to prevent the control and drive shafts from rotating in each of the clockwise and counter-clockwise rotation directions after said control shaft reaches a determined intermediate position between said first and second angular positions when said rotating has not been authorized, by interposing a stop element in a rotation path followed by a projecting element carried by one of the control and drive shafts as said one shaft rotates.

2. Control apparatus according to claim 1, wherein the stop element comprises two moving stop elements that respectively correspond to the clockwise and counter-clockwise rotation directions and that are movable when electrically or mechanically commanded, and wherein one of the moving stop elements co-operates with the projecting element, and wherein the projecting element comprises one of the two studs.

3. Control apparatus according to claim 2, wherein the moving stop elements comprise two stop levers disposed in a "bell crank" configuration so as to form an assembly that rotates about an axis situated at the vertex of the bell crank so as to rotate from a first limit position in which one of the stop levers is interposed in the path followed by one of the studs, so as to prevent the drive shaft from rotating in one of a clockwise and counter-clockwise rotation direction, to a second limit position for which the other one of the stop levers is interposed in the path followed by the other stud so as to prevent the drive shaft from rotating in the other of the clockwise and counter-clockwise rotation direction, and vice versa.

4. Control apparatus according to claim 3, further comprising a drive lever operative to rotate the bell crank in one of the clockwise and counter-clockwise rotation directions, the drive lever electrically controlled by an electromagnet.

5. A control device according to claim 3, wherein each of the two stop levers has an abutment end that, for each limit position in the rotation of the bell crank, is controllably interposed in a rotation path followed by one of the studs, each of the stop levers having a curved stud-abutment edge which is recessed progressively between the abutment end and the vertex of the bell crank, on an inside portion of the bell crank.

6. Control apparatus according to claim 3, wherein the bell crank formed by the two stop levers is disposed to rotate about a longitudinal axis of the control shaft.

7. Control apparatus according to claim 1, further comprising a cam fixed to and rotated by said drive shaft, said cam having an outer-facing surface with a shape complementary to a portion of an outer-facing surface of said Maltese cross;

wherein said Maltese cross cooperates with said cam as said cam is rotated.

* * * * *